United States Patent [19]

Schwartzberg

[11] Patent Number: 4,496,149

[45] Date of Patent: Jan. 29, 1985

[54] GAME APPARATUS UTILIZING CONTROLLABLE AUDIO SIGNALS

[76] Inventor: Robert B. Schwartzberg, 41 Madison Ave., Fanwood, N.J. 07023

[21] Appl. No.: 440,544

[22] Filed: Nov. 10, 1982

[51] Int. Cl.[3] ..... A63H 5/00

[52] U.S. Cl. ..... 273/1 E; 273/58 E; 446/11; 446/117; 446/232; 446/484

[58] Field of Search ..... 273/1 R, 1 E, 1 GC, 273/213, 58 E, 58 D, 237, DIG. 27, 58 G; 46/232, 256, 262; 446/11, 86, 117, 177, 176, 196, 484

[56] References Cited

U.S. PATENT DOCUMENTS

| | | | |
|---|---|---|---|
| 4,221,927 | 9/1980 | Dankman et al. | 46/232 |
| 4,249,339 | 2/1981 | Crain et al. | 46/232 |
| 4,270,751 | 6/1981 | Lowy | 273/DIG. 27 |
| 4,288,537 | 9/1981 | Knetzger | 46/232 |
| 4,314,423 | 2/1982 | Lipsitz et al. | 46/232 |
| 4,398,892 | 8/1983 | Solomon | 46/232 |

*Primary Examiner*—Richard C. Pinkham
*Assistant Examiner*—MaryAnn Stoll Lastova
*Attorney, Agent, or Firm*—Arthur L. Plevy

[57] ABSTRACT

There is disclosed a game apparatus employing a container having located therein an electronic circuit capable of emitting a repetitive audio signal of a controllable volume and repetition rate. The container includes a compartment in which a prize or award is placed by the players. The container is then hidden by one of the players who selects the repetition rate and volume to thereby cause audio signals to propagate. The participants then attempt to locate the container in response to the emitted signals and the first participant who finds the container has access to the prize. The degree of difficulty is determined by the volume and repetition rate of the signal as controlled by the player hiding the same.

5 Claims, 3 Drawing Figures

GAME APPARATUS UTILIZING CONTROLLABLE AUDIO SIGNALS

BACKGROUND OF INVENTION

This invention relates to a game apparatus in general and more particularly to a container capable of emitting controllable sounds to enable the players to respond to the sounds in order to locate the container when hidden.

As one can ascertain, the game of Hide and Seek has long been played and children of all ages enjoy participating in such activities.

The present disclosure involves a game which may be designated as Hide and Beep or Beep and Seek. Essentially, the apparatus employed in this game includes a container or housing having located therein an electronic circuit of the type capable of emitting controllable sound signals of a controllable repetition rate and volume. A selected player then sets the levels by means of suitable controls located in the housing. The housing further includes a compartment in which the player may deposit a trinket or party favor. The housing is then hidden from view in a location known only to the selected player. The other players listen for the sounds emitted to lead them to the housing. The first player who successfully locates the same may then retrieve the award.

There are numerous modifications of the apparatus which will enable different formats and structures to be accommodated to allow the basic game to be played according to various and diverse considerations.

BRIEF DESCRIPTION OF THE PREFERRED EMBODIMENT

A game apparatus for enabling a plurality of players to locate an object by sound emanating from said object, comprising a housing manifesting said object and having an internal hollow, circuit means included within the hollow of said housing and operative to provide an audible sound signal indicative of a series of spaced beeps to enable said players to respond to said audible signals in an attempt to locate said housing.

DETAILED DESCRIPTION OF THE FIGURES

Figure 1:
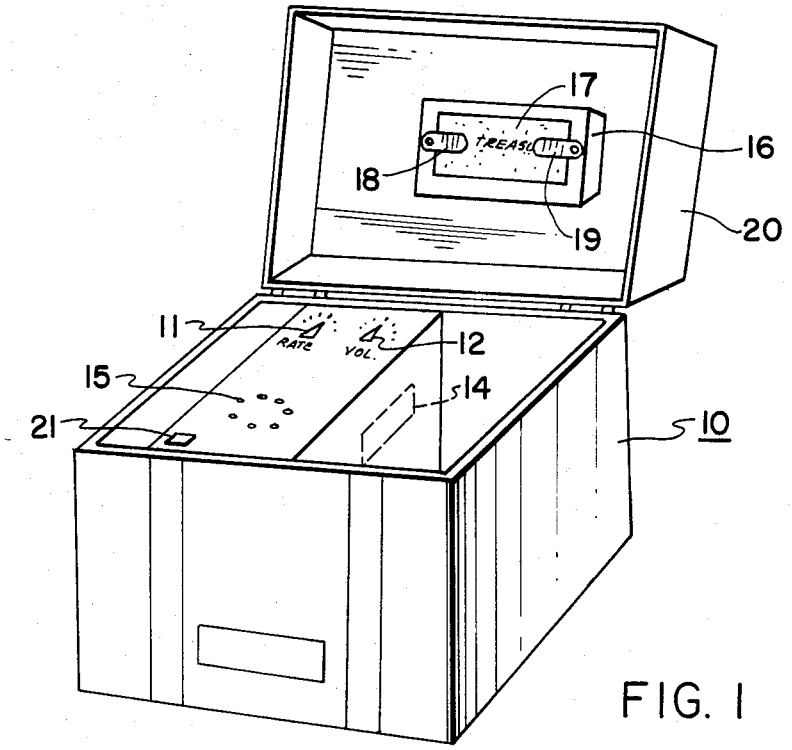
FIG. 1 is a perspective plan view of a game apparatus according to this invention.

Referring to FIG. 1, there is shown a housing or container 10. The container 10 while shown as a rectangular configuration can take any shape or be of any size sufficient to contain an electronic circuit which is of the type capable of providing audible sound signals of a controllable repetition rate and volume. Examples of a plurality of such circuits are well known in the art and reference is made to a text entitled *Guidebook of Electronic Circuits* by John Markus, published by McGraw-Hill Book Company (1974). In that text, Chapter 36 entitled "Flasher Circuits" depicts a host of circuits which are capable of driving a speaker or buzzer to emit an audible sound whose rate and volume are controllable.

Thus, located within the housing 10 is such a circuit. The housing 10 further includes a first control means such as a knob or control 11 which serves to vary the repetition rate of the emitted signal as will be explained. Another control knob 12 is also shown which enables a player to select the volume or intensity of the emitted signal. Located within the housing 10 is a conventional battery 14 which may be a dry cell as a flashlight battery or a nine-volt battery as commonly employed.

The housing 10 contains a speaker 15 or other device such as a piezoelectric buzzer which, when activated by a suitable signal, will cause sound to propagate.

Also included in the housing is a compartment 16 having a front cover 17 which is secured to the sides of the housing by means of pivotable latches 18 and 19 to allow a player to remove the cover 17 and place a trinket or prize within the compartment which prize will be available to the player who locates the unit when hidden.

In the embodiment shown in FIG. 1, the compartment 16 is located on a cover member or lid 20 associated with the housing 10. It is of course understood that the compartment 16 may be positioned anywhere within the housing or in fact need not be a separate unit as a prize or trinket can be emplaced within the hollow confines of the housing as well.

It will be understood that the housing configuration can take on many shapes and designs to accommodate a wide variety of different game formats to present extra attraction to children or players.

In one embodiment the housing 10 was structured and designed to have an outer appearance resembling a pirate's treasure chest. In employing the housing 10 a game has been devised which is a treasure hunt and the rules are as follows:

One player is selected to hide the treasure chest 10 and to control the volume and repetition rate according to his preferences. The selected player is called the pirate. The pirate requests all the other players to leave the designated playing area whereby he then sets the controls as desired, places a small trinket or party favor into the compartment 16. He then proceeds to hide the chest 10 and turns on the power via a suitable switch 21. The chest 10 now emits a beep of a volume and repetition rate as selected. The other players are now called into the area and they proceed to attempt to locate the chest 10 by responding to the sound. The player that locates the chest can retrieve the trinket and he now becomes the pirate.

As one can ascertain from the above example, the variations on the format are many and hence the housing 10 can be decorated or formulated to resemble a host of various devices to be located. Thus, the housing can assume the shape of a space ship, a robot, animals and so on. Such configurations and alterations are numerous.

Figure 2:
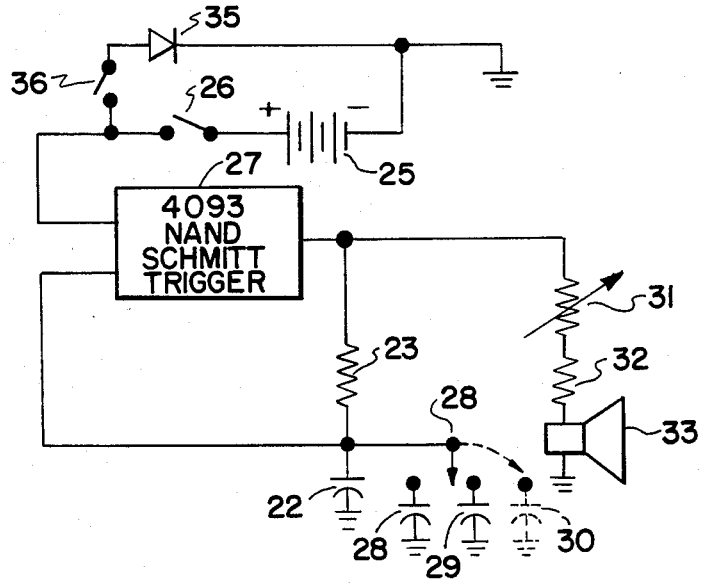
FIG. 2 is a schematic diagram of a beeper circuit employed with the housing of FIG. 1.

Referring to FIG. 2, there is shown a schematic of an actual circuit employed to emit a beep having a variable repetition rate and volume. As indicated above, the circuit shown is by way of example and there are a host of alternative circuits and configurations which will operate as well. In implementing the beeper which is mounted in the housing 10, a nine-volt battery 25 is employed as the power source. The battery 25 is typical of the type of battery utilized to power hand held calculators and other devices. The negative terminal of the battery is at reference potential while the positive terminal is directed onto an on/off switch 26 which supplies power to an integrated circuit 27. The integrated circuit in this particular example is a type 4093 circuit described as a NAND Schmitt Trigger.

Essentially, the NAND Schmitt Trigger is a well known circuit and can operate to produce a ramp wave form of a variable repetition rate depending upon the circuit components employed. The output of the integrated circuit is coupled through a timing resistor 23 to a series of capacitors 22 and 28–30. As is well known, the selection of a particular capacitor controls the operating frequencies of the Schmitt Trigger device and hence capacitor 22 is a fixed capacitor which determines the highest operating frequency. A frequency or rate selector switch 28 which is analogous to switch 11 of FIG. 1 is operative to parallel capacitor 22 with any of the selected capacitors as 28–30.

Figure 3:
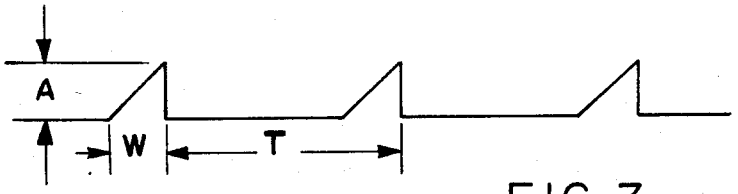
FIG. 3 is a simple diagrammatic view of a typical wave-form produced by the circuit of FIG. 2.

In this manner the operating frequency of the Schmitt Trigger is varied. A feedback point is derived from the RC network consisting of resistor 23 and capacitor 22 or the parallel combination of capacitors as selected by switch 28 and is applied to the control input of the Schmitt Trigger. In this manner, the Schmitt Trigger will produce an output which is a repetitive waveform of the type shown in FIG. 3. The waveform may have a fixed pulse width W between a varying repetition rate T. This output waveform is used to drive a piezoelectric buzzer 30 via the series resistors 31 and 32. Resistor 32 may be a potentiometer to thereby alter the amplitude A of the waveform as applied to the buzzer 30. Also shown in FIG. 2 is a LED device 35 which is coupled across the battery by means of a momentary switch 36. If switch 36 is operated, the LED device 35 will illuminate indicating to the user that the battery is operative.

As shown in FIG. 2 by the selection of a capacitor via switch 28, the player can alter the rate of the audio signal and by controlling the potentiometer 31, the player can alter the amplitude of the signals, thus the circuit will produce a series of audible beeps via the buzzer 30. The intensity of the beeps and the repetition rate can be varied as above described.

It is therefore understood that the selected player, by varying the controls, can then cause the beeper to produce a sound which is followed by a predetermined or selected pause. For example, the unit can provide a sound which remains on for a period of two or more seconds and then stays off for a period of two seconds, then goes on again and so on.

The amplitude of the signal can also be varied so that the intensity of the sound emitted from buzzer 30 is likewise controlled. Thus, according to the interval of the signal and the intensity, one can achieve greater degrees of difficulty for the players attempting to locate the housing containing the circuit of FIG. 2. As is known, a sound which is produced by such an object is relatively difficult to locate due to the fact that sound is reflected from various structures such as walls and so on. Hence the player will experience difficulty in accurately responding to the sound in order to locate the hidden housing. It is, of course, understood that by having the ability to vary the rate as well as the volume, this task can become more difficult as controlled by the selected player. The above described concept has many manifestations, and it is understood that the repetition rate can be varied to produce a plurality of different rates depending upon the sophistication and skill of the players. It is also understood that many alternate circuit configurations can be employed in lieu of the above described structure depicted in FIG. 2. In any event, the circuit, including the battery, is extremely small and can be contained in many housings, as explained above, of various configurations and sizes.

In a preferred embodiment as shown in FIG. 2, the resistor 23 constitutes four series resistors, three of which were selected to be at 1,000 ohms with a fourth resistor of 82 ohms. Capacitor 22 was selected to be 470 microfarads as was capacitor 28 Capacitor 29 was selected to be 220 microfarads. The piezoelectric buzzer 30 is a conventional unit available through many manufacturers as is the integrated circuit which, as indicated, is a NAND Schmitt Trigger. Resistor 31 could be a potentiometer having a value of 10,000 ohms with resistor 32 being about a 1,000 ohms. The above noted circuit dissipates a small amount of power and is capable of being energized by a typical nine-volt battery for relatively extended periods. It is understood that there are many alternate circuit configuration which can be employed to produce the required sound necessary to participate in the above described game.

As indicated above, the sound emanating from the unit affords a difficult challenge, as during normal operation, an ordinary individual would have a difficult time in determining the exact location of the sound. In this manner the game is extremely intriguing and may be adapted to be played by both children and adults.

The housing which also contains the compartment provides further incentive to the participant in attempting to locate the unit during the game. It is also understood that in lieu of a beep one can employ a more sophisticated integrated circuit which would cause the box to emit a specified word or statement during selected intervals such as, Help!, find me, and so on.

In view of the above description it should be apparent that the shape and size of the housing can vary widely, and one can implement games which are directed towards various professions with the intent and objective of locating the hidden unit by responding to the emitted sounds.

It is also understood that the frequency, as well as the duration between sounds, can be varied as desired to thereby fabricate such devices for use by adults and children.

I claim:

1. A game apparatus employing an object capable of emitting an audible signal to enable one successful player of a plurality of players to locate the object, when hidden, by responding to the sound emanating from said object, comprising:

a housing manifesting said object and having an internal hollow, said housing being of a box-like configuration with an opened top and having a cover member pivotally secured to said housing for selectively covering said opened top, an oscillator circuit located in the hollow of said housing and operative when energized to provide an output signal manifesting a repetitive waveform of an adjustable amplitude and rate; control means positioned in said housing and coupled to said oscillator circuit to selectively adjust the amplitude and rate of said waveform wherein said control means includes a first control means for independently varying the amplitude of said oscillator circuit and a second control means for independently varying the rate of said oscillator whereby a player can select both the amplitude and frequency of the waveform according to his preference, said oscillator providing a ramp voltage output signal where the duration between ramps is controlled by said second control means, sound producing means responsive to said ramp output signal to produce an audible signal according to said ramp waveform, and repository means located in said housing for retaining an award deposited therein by a player as an incentive to said successful player capable of locating said housing by responding to the sound emitted from said housing.

2. The game apparatus according to claim 1, further including a battery located within said housing and coupled to said oscillator circuit for energizing the same.

3. The game apparatus according to claim 2, further including visual indicator means selectively coupled in circuit with said battery and operative when selected to provide a visual indication manifesting a proper battery condition.

4. The game apparatus according to claim 3, wherein said visual indicating means is a light emitting diode (LED).

5. The game apparatus according to claim 1, wherein said sound producing means is a piezoelectric buzzer.

* * * * *